US006010241A

United States Patent [19]

Bulgari

[11] Patent Number: 6,010,241

[45] Date of Patent: Jan. 4, 2000

[54] WATCH

[75] Inventor: Giovanni Bulgari, Geneva, Switzerland

[73] Assignee: Enigma S.A., Geneva, Switzerland

[21] Appl. No.: 09/169,927

[22] Filed: Oct. 9, 1998

Related U.S. Application Data

[63] Continuation of application No. PCT/IB97/00380, Apr. 10, 1997.

[51] Int. Cl.[7] ..... G04B 27/02

[52] U.S. Cl. ..... 368/190; 368/187

[58] Field of Search ..... 368/185, 190–195, 368/196, 187, 188

[56] References Cited

U.S. PATENT DOCUMENTS

| | | | |
|---|---|---|---|
| 2,547,140 | 4/1951 | Schmitz | 368/190 |
| 4,253,177 | 2/1981 | Hafner | 368/187 |
| 5,083,300 | 1/1992 | Schwartz | 368/185 |
| 5,377,171 | 12/1994 | Schlup | 368/220 |
| 5,742,565 | 4/1998 | Cuinet et al. | 368/190 |

FOREIGN PATENT DOCUMENTS

| | | |
|---|---|---|
| 0 608 535 | 8/1994 | European Pat. Off. . |
| 21 674 | 1/1921 | France . |
| 20 34 041 | 2/1971 | Germany . |
| 30 29 660 | 2/1981 | Germany . |
| 65 378 | 7/1913 | Switzerland . |
| 318 834 | 12/1956 | Switzerland . |
| 473 411 | 5/1969 | Switzerland . |
| 685 087 | 3/1995 | Switzerland . |
| 2 165 672 | 4/1986 | United Kingdom . |

*Primary Examiner*—Bernard Roskoski
*Attorney, Agent, or Firm*—Henderson & Sturm

[57] ABSTRACT

This invention is directed to a watch which includes a rotating bezel with a ring-shaped part projecting from its lower surface and with a serrated edge at the end. This ring-shaped part is fitted into an indentation in the rim and its toothed part meshes with a pinion with an axial aperture of square cross-section fitting onto a segment of complementary cross-section on the winding stem. The pinion is located in a case open laterally on the external surface of the rim and maintained in this case by a shutting device. The winding stem can be axially moved between at least two positions while remaining constantly meshed with the rotating bezel by means of the pinion allowing the rewinding or setting of the watch by rotating the bezel.

12 Claims, 1 Drawing Sheet

WATCH

This application is continuation of PCT/IB97/00380 filed Apr. 10, 1997.

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a watch comprising a casing fitted with a rotating bezel, an annular part of which is toothed, a winding stem delimiting a segment of polygonal cross section situated outside the watch movement, a pinion furnished with an aperture of complementary cross section to that of the said segment, engaged thereon, the toothing of the pinion meshing with that of the said toothed annular part, forming a kinematic link between the rotating bezel and the winding stem.

2. Description of the Prior Art

Such watches have already been described in CH 1825 and CH 72852. In each of the solutions proposed, the rotating bezel meshes with a toothed wheel associated with a lever intended for selectively connecting the rotating bezel to the mainspring winding mechanism or to the time-setting gearing.

These solutions require a complete transformation of the watch movement, so that only watches equipped with such movements can be wound via the rotating bezel.

Another solution has been proposed in CH 662235, in which the rotating bezel is fitted with a toothing which meshes, on the one hand, with a pinion integrated with the winding stem, and on the other hand, with a wheel of a time-setting mechanism mounted on an auxiliary plate. The purpose of this solution is to enable a winding and time-setting mechanism to be allied via the rotating bezel without transforming the movement, but by appending an additional module thereto, mounted on the auxiliary plate.

Such a watch nevertheless has several drawbacks. It requires an additional mechanism and the auxiliary plate which carries it substantially increases the height of the movement. Furthermore, if it is desired simultaneously to wind the watch, the time-setting lever is driven and, after a certain angle of rotation, it causes a reverser carried by the lever to mesh with a time-setting pinion, so that if care is not taken so as not to exceed this angle of rotation of the bezel, the time is changed, whereas it was desired only to wind the watch.

Other systems for winding and time-setting via the bezel have been described in CH-A-316 834, as well as in CH-A-65 378. In both instances, the pinion which gears with the toothed crown of the rotating bezel is fully integrated with the winding stem in terms of rotation and translation. In the first of these two documents, the moving of the winding stem causes the toothing of the pinion to part slightly from the toothed crown of the bezel, thus running the risk of damaging these toothings. The second of these documents does not have this drawback, given that the width of the toothed crown has been increased accordingly so as to gear with the pinion of the winding stem in both axial positions of the latter. This solution, intended for a car dashboard clock, would not be suitable for a wristwatch, given that it would increase the width of the rim, impairing the aesthetics of the case.

Although the fashioning of a winding stem segment of square cross section, making it possible to drive the clutch pinion in all its axial positions, for winding and for time-setting, has been well known for all winding mechanisms for nearly a century, this does not however address the matter of holding this clutch pinion axially stationary. On the contrary, this clutch pinion is moved axially in the opposite direction to the winding stem, by way of the time-setting pull-out piece and lever, so as to mesh it with the time-setting reverser.

BRIEF SUMMARY OF THE INVENTION

The purpose of the present invention is to remedy, at least in part, the abovementioned drawbacks and to arrange for the winding of the watch, which hitherto was perceived as a negative operation, and which has been eliminated from automatic and electric watches, to become a pleasant and entertaining experience which, in contrast to a watch wound via the winding stem, is wound more easily while keeping it on the wrist. As will be seen in the description which follows, apart from the purely mechanical design of the winding device, provisions have been made to protect it from dust and to ensure that the rotating bezel and the protective seals have a long lifetime.

To this end, the subject of this invention is a watch of the abovementioned type, characterized in that the said pinion is positioned axially between two stops integrated with the casing, the said segment of polygonal cross section of the winding stem having a length chosen so as to enable the said winding stem to be moved axially between at least two positions, one for winding and the other for time-setting, whilst maintaining the kinematic link between the bezel and the winding stem by way of the said pinion.

According to other features of this invention, it will be mentioned that, preferably, the normal spring of a manually wound watch is replaced by a slipping spring such as those used in automatically wound watches. Specifically, the rotating bezel makes it possible to exert a torque on the spring which is substantially greater than that exerted by way of the winding stem. Consequently, it is extremely advantageous that once the drive spring has been fully tensioned, it can slip in the barrel, so that it is possible to continue rotating the bezel indefinitely, even though the spring is fully tensioned, without running the risk of damaging the spring.

Since in this instance, winding is endless, the user does not know whether or not the spring is tensioned. It may therefore be advantageous to append an indicator of the degree of tensioning of the drive spring, which is a device known per se.

The watch according to the invention does not require any modification as regards the movement proper, the only necessary modification being that of the winding stem. It is therefore possible, by virtue of the present invention, to adapt the winding system to any watch by changing only the winding stem.

BRIEF DESCRIPTION OF THE SEVERAL VIEWS OF THE DRAWINGS

The appended drawing illustrates, diagrammatically and by way of example, an embodiment of the watch which is the subject of the present invention.

DETAILED DESCRIPTION OF THE INVENTION

Figure 1:
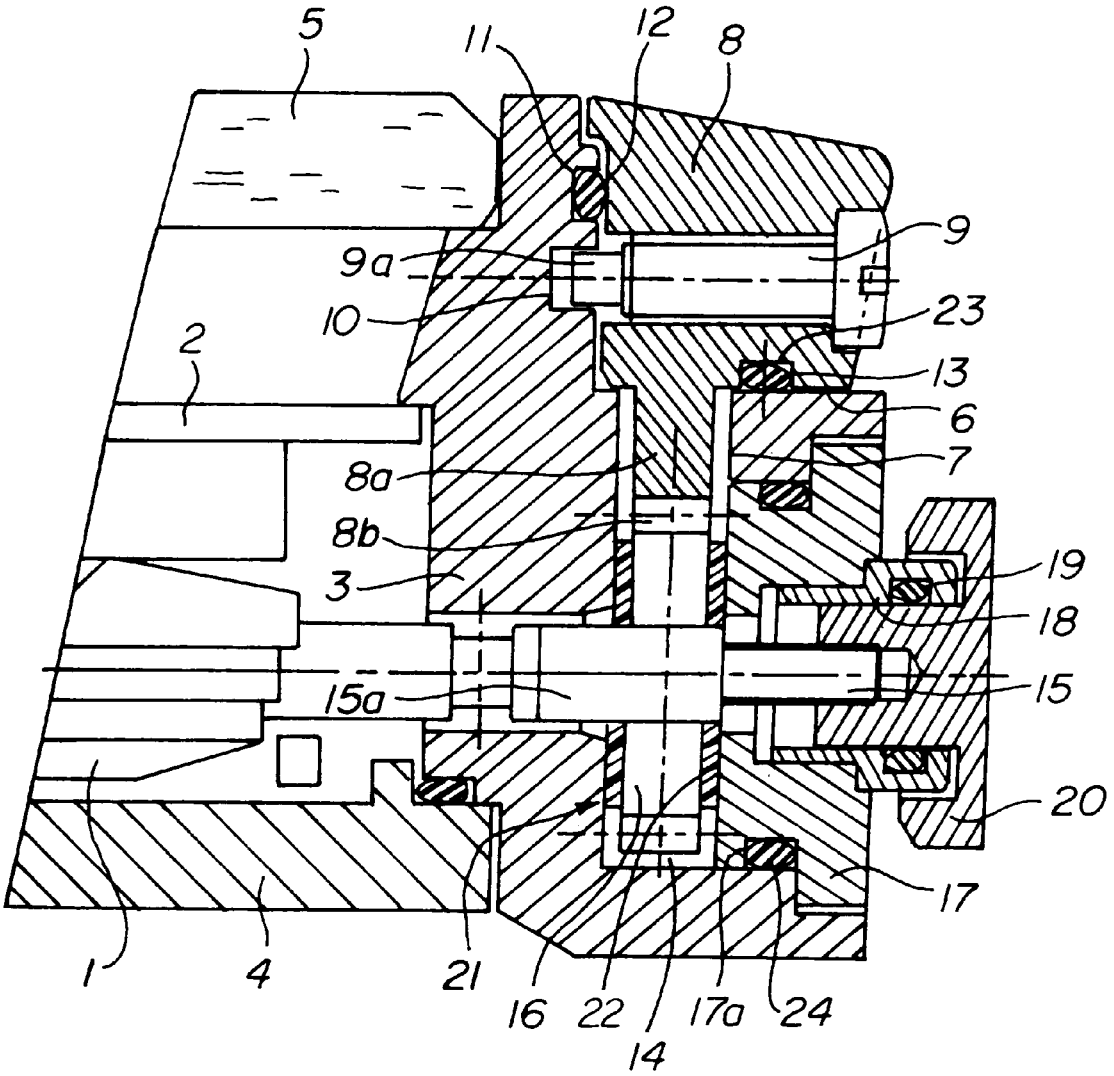
FIG. 1 is a partial axial sectional view of this watch.

The watch illustrated by this figure comprises a movement 1 covered by an indicator dial 2, housed in a casing comprising a rim 3, a bottom 4 and a crystal 5.

Figure 2:
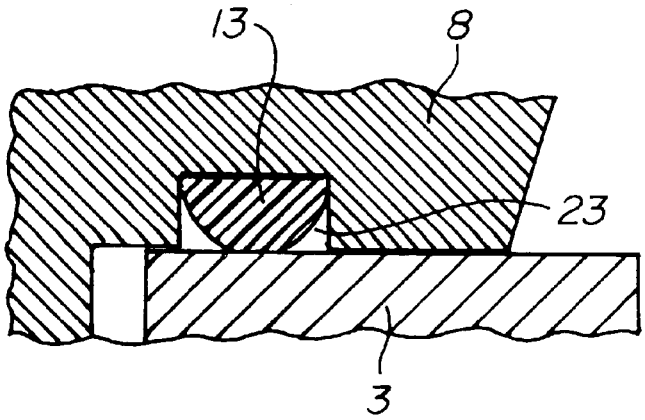
FIG. 2 is an enlarged view of a detail of FIG. 1.

The upper part of the rim 3 has an annular recess 6 in the bottom of which is made an annular groove 7. A rotating bezel 8 is disposed in the annular recess 6 and is retained axially by pins 9*a* which are made directly in line with the screw end 9, pass radially through the rotating bezel 8 and are angularly distributed thereabout. These pins 9*a* are engaged in an annular groove 10 in the lateral face of the annular recess 6. An annular groove 11 parallel to the annular groove 10 serves to receive an O-ring seal 12. A second seal 13 is housed in an annular groove 23 made in the lower face of the rotating bezel 8. As may be seen in FIG. 2, preferably, this seal 13 has a semicircular cross section, its plane face being cemented into the bottom of the groove 23. The shape of the seal 13 and the cementing thereof make it possible to increase its lifetime and facilitate the turning of the rotating bezel 8 in both directions. The seal 12, for its part, is preferably an O-ring seal.

The lower face of this rotating bezel furthermore has a projecting annular part 8*a* at the end of which an edgewise toothing 8*b* is made, this annular part 8*a* being housed in the annular groove 7.

This groove 7 communicates with a cylindrical housing 14, whose axis of revolution coincides with the axis of the winding stem 15. This winding stem 15 includes a segment of square cross section 15*a* which passes through an aperture of the same cross section, centered on the axis of a pinion 16 gearing with the toothing 8*b*. A closure member 17, carrying a tube 18 fitted with an O-ring seal 19 intended to cooperate with a winding crown 20, is fastened into the cylindrical housing 14 by two screws (not represented), fixed into the rim 3 on either side of the winding stem 15. In this way, the pinion 16 is fixed axially between two stops consisting of the bottom of the cylindrical housing 14 on the one hand, and the internal face of the closure member 17. The lateral face of the latter has a groove 17*a* in which is housed an O-ring seal 24. Spacers , 21, 22, made for example of nylon, can be disposed on either side of this pinion 16 to prevent it from seizing. By virtue of this provision, the segment of square cross section 15*a* of the winding stem 15 can slide freely through the aperture in the pinion 16 and the latter remains meshed with the toothing 8*b* of the rotating bezel. In this way, the winding stem 15 can occupy various positions, two or three for winding, time-setting, or even date-setting, like a normal winding stem, the kinematic link remaining constantly established between the rotating bezel 8 and the winding stem 15, by way of the pinion 16 rotationally integrated with this stem 15 by virtue of the segment 15*a* of square cross section.

It is therefore clearly apparent that no modification or addition is necessary as regards the clockwork mechanism proper. The modifications are involved only in respect of the casing and of the part of the winding stem outside the movement. Advantageously and so as to enable the rotating bezel 8 to be rotated indefinitely, which may afford the user some recreational aspect, it is possible to use a slipping mainspring as in an automatic watch. This makes it possible to prevent any risk of damaging the drive spring.

It may also be observed that the winding and time-setting mechanism is completely protected against the ingress of water and dust through the seals, thus sheltering this mechanism from damage or from the seizing up of the moving parts, rotating bezel 8 and pinion 16.

The casing up of the watch is only very slightly modified as compared with a normal case. Once the movement has been placed in the case, before fixing the bottom 4, the winding stem 15 is set in place as usual and is fixed, as in all watches, by screwing up the pull-out piece screw (not represented). Next, it is merely necessary to insert the pinion 16 axially and to engage it on the segment of square cross section 15*a* of this stem, after which the closure member 17 is set in place and is fixed to the rim 3 by two screws (not represented) disposed on either side of the winding stem 15. Next, it remains to set the rotating bezel 8 in place and to screw in the fixing screws 9 so as to retain the rotating bezel 8 on the rim 3, whilst allowing it to rotate so as to drive the pinion 16 and the winding stem 15 in order to wind or set the watch to time, depending on the axial position of this stem 15.

What is claimed is:

1. A watch comprising a casing fitted with a rotating bezel, and housing a watch movement a toothed annular part comprising teeth, a winding stem delimiting a segment of polygonal cross section situated outside the watch movement, a pinion furnished with an aperture of complementary cross section to a cross section of said segment, engaged thereon, said pinion comprising pinion teeth which mesh with said teeth of said toothed annular part, forming a kinematic link between the rotating bezel and the winding stem, wherein said pinion is positioned axially between two stops integrated with the casing, and said segment of polygonal cross section of the winding stem having a length chosen so as to enable said winding stem to be moved axially between at least two positions, comprising a winding position for winding and a time-setting position for time-setting while maintaining the kinematic link between the rotating bezel and the winding stem by way of the said pinion.

2. A watch according to claim 1, wherein said toothed annular part comprises a projecting annular part projecting beneath the rotating bezel and having an edgewise toothing, said projecting annular part extending in an annular groove in a rim.

3. A watch according to claim 2, wherein said pinion is disposed in a housing opening out onto an external lateral face of the rim, communicating with said annular groove in the rim said pinion being held by a closure member fixed to the rim.

4. A watch according to claim 1, wherein the rotating bezel is retained axially on a rim by screws passing radially therethrough, said screws comprising ends which are engaged in an annular groove in a lateral face of the rim.

5. A watch according to claim 3, comprising a winding mechanism, a time-setting mechanism and seals for insulating the winding mechanism and the time-setting mechanism from surrounding environment.

6. A watch according to claim 1, comprising at least one annular seal of semicircular cross section disposed between the rotating bezel and a rim, said at least one annular seal comprising a cemented plane face.

7. A watch according to claim 1, comprising the drive spring comprising a spring of a slipping type.

8. A watch according to claim 2, comprising a drive spring comprising a spring of a slipping type.

9. A watch according to claim 3, comprising a drive spring comprising a spring of a slipping type.

10. A watch according to claim 4, comprising a drive spring comprising a spring of a slipping type.

11. A watch according to claim 5, comprising a drive spring comprising a spring of a slipping type.

12. A watch according to claim 6, comprising a drive spring comprising a spring of a slipping type.

* * * * *